United States Patent [19]

Brunone et al.

[11] Patent Number: 4,463,893

[45] Date of Patent: Aug. 7, 1984

[54] REPLACEABLE LID FOR FLANGED TRAYS

[75] Inventors: William T. Brunone, Plymouth; Duane Mode, Eden Prairie, both of Minn.; Michael R. Russell, Grand Ledge, Mich.

[73] Assignee: Champion International Corporation, Stamford, Conn.

[21] Appl. No.: 467,737

[22] Filed: Feb. 18, 1983

[51] Int. Cl.[3] ..... B65D 5/64

[52] U.S. Cl. ..... 229/43; 206/468; 206/633; 229/7 SC

[58] Field of Search ..... 229/43, 9, 7 SC; 206/468, 633; 220/351, 359

[56] References Cited

U.S. PATENT DOCUMENTS

| | | | |
|---|---|---|---|
| 2,077,047 | 4/1937 | Kondolf | 229/43 |
| 2,102,094 | 12/1937 | Romig | 220/351 |
| 3,074,611 | 1/1963 | Tolaas | 229/9 |
| 3,215,333 | 11/1965 | Stelzer | 206/633 X |
| 3,393,860 | 7/1968 | Maki | 229/43 |
| 3,580,478 | 5/1971 | Bemiss | 229/43 |
| 3,715,073 | 2/1973 | Gibbs | 229/43 |
| 3,862,703 | 1/1975 | Dutcher | 229/43 |
| 3,876,133 | 4/1975 | Smith | 229/43 |
| 4,190,191 | 2/1980 | Forbes | 229/43 |
| 4,360,148 | 11/1982 | Forbes | 229/43 |

FOREIGN PATENT DOCUMENTS

| | | | |
|---|---|---|---|
| 2144653 | 3/1973 | Fed. Rep. of Germany | 229/43 |
| 1384547 | 2/1975 | United Kingdom | 206/468 |

*Primary Examiner*—William Price
*Assistant Examiner*—Gary E. Elkins
*Attorney, Agent, or Firm*—Evelyn M. Sommer

[57] ABSTRACT

A replaceable lid for a flanged tray in which the lid has opposed slide channels to receive the tray flanges in order to permit the lid to slide off the tray and be reapplied to the tray. A tamper resistant safety tab may also be provided to prevent tampering with the contents of the tray when the tray is on a shelf. The lid is made of a single blank having two panels with one of the panels having an opening to receive the tray and the other panel being folded over the first panel of the tray and adhered to the first panel along its outer edges.

11 Claims, 7 Drawing Figures

REPLACEABLE LID FOR FLANGED TRAYS

BACKGROUND OF THE INVENTION

The present invention refers to flanged trays or containers and more particularly to a replaceable lid for such flanged trays or containers.

Flanged trays or containers for foods comprise a container body and a flange which extends outwardly from the upper rim of the container body. Such flanged trays or containers may be oven resistant and are often used to heat and cook foods in microwave ovens. The flanged trays are shelved and sold either in outer containers or with a paper lid which is sealed directly to the flanged tray. In using these flanged trays, the outer carton or the paper lid is removed and the trays are placed in an oven.

With the type of trays presently in use, if there is any food left in the tray, it is not possible to re-cover the tray since its outer carton or lid has been removed and destroyed. Furthermore, if the trays are stacked on top of each other, it is possible that the downward pressure may unfold, expand or collapse the trays outwardly.

The present invention overcomes these drawbacks and has for one of its objects the provision of an improved lid for a tray which is easily reusable as a cover for the tray.

Another object of the present invention is the provision of an improved tray having a cover which can be easily removed and replaced on the tray.

Another object of the present invention is the provision of an improved lid for a flanged tray which uses less paperboard.

Another object of the present invention is the provision of an improved replaceable lid for a flanged tray.

Another object of the present invention is the provision of an improved tray having a lid which will give the tray stability.

Another object of the present invention is the provision of an improved lid for a tray which has a tamper-resistant safety tab.

Other and further objects of the invention will be obvious upon an understanding of the illustrative embodiment about to be described, or will be indicated in the appended claims, and various advantages not referred to herein will occur to one skilled in the art upon employment of the invention in practice.

The improved replaceable lid of the present invention is adapted to be used with a flanged tray having a flange extending outwardly from the upper edge of its side walls. The lid comprises a blank which is folded over the flange of the tray and which is adhered to itself rather than to the tray in order to form opposed slide channels for the tray flange. When the tray is to be used, the tray slides out of the lid channels from one end thereof. After the tray is used, if there is any food contents left, the lid is slid back onto the tray through the slide channels to re-cover it. If desired, the lid may be used with a tray that has a peelable seal over the opening. Furthermore, the lid may be formed so that a tamper-resistant safety panel must be torn away before the lid can be removed in order to prevent tampering with the contents of the tray when the tray is on a shelf.

BRIEF DESCRIPTION OF THE DRAWINGS

A preferred embodiment of the invention has been chosen for purposes of illustration and description and is shown in the accompanying drawings forming a part of the specification, wherein.

DETAILED DESCRIPTION OF THE INVENTION

Figure 1:
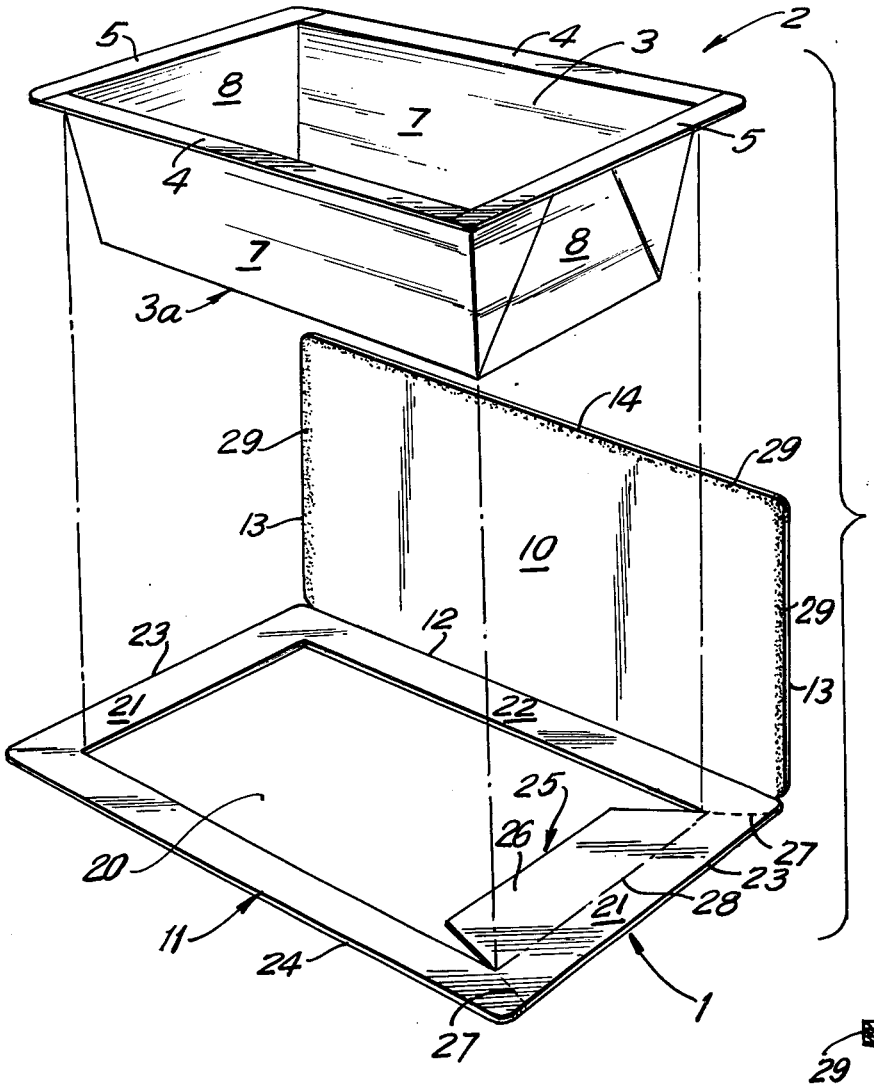
FIG. 1 is an exploded perspective view showing the improved lid of the present invention.

Referring to the drawings and more particularly to FIG. 1, the lid 1 of the present invention is adapted to be used with a tray 2 having an open top 3 and side and end flanges 4 and 5, respectively, extending substantially horizontally and outwardly from the upper rim 6 thereof. The body portion 3*a* of the tray 2 comprises a bottom wall 9 (FIG. 4), a plurality of upstanding side and end walls 7 and 8, respectively, from which the said peripheral flanges 4 and 5 extend, respectively. The tray 2 may be made from a paperboard material or from any other similar conventional material and is preferably made from a single blank (not shown) folded and adhered together to form the finished tray. However, it will be understood that the lid 1 of the present invention is adapted to be used with a flanged tray regardless of the manner in which the tray is manufactured.

Figure 3:
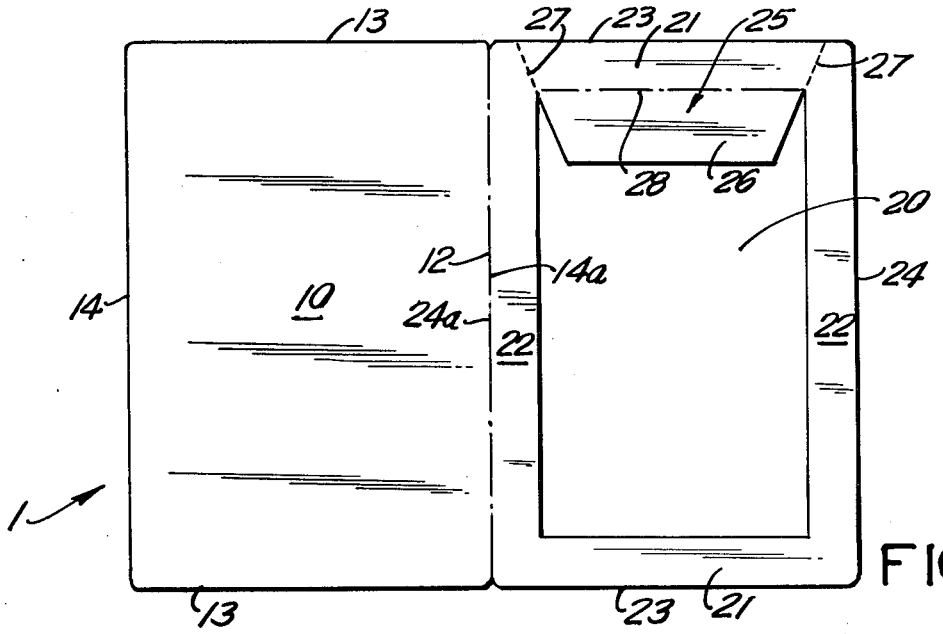
FIG. 3 is a plan view of a blank used for making the lid of the present invention.

The lid 1 of the present invention is made from a one-piece blank (FIG. 3) having a top panel 10 and a bottom panel 11 foldable relative thereto along a fold line 12. The top panel 10 and the bottom panel 11 are substantially identical in size and shape so that when they are folded and superimposed relative to each other the two match each other.

The top panel 10 is shown in the drawing as being a solid panel although it will be understood that it is within the purview of the invention for the top panel to have transparent portions, if desired. The top panel has end edges 13, an outer side edge 14 and an inner side edge 14*a* coincident with fold line 12.

The lower panel 11 of the blank 1 has a large central opening 20 therein to form peripheral end and side elements 21 and 22, respectively. The lower panel 11 has end edges 23, an outer side edge 24 and an inner side edge 24*a* coincident with the fold line 12. The opening 20 is preferably substantially the same size as the opening 3 in the tray 2 and the frame elements 21 and 22 are preferably larger than the flanges 4 and 5 of the tray 1.

One of the end frame elements 21 forms a removable tamper-resistant safety assembly 25 comprising a pull tab 26 extending inwardly from and foldably relative thereto along a fold line 28 and a pair of end perforated tear lines 27. When the pull tab 26 is pulled, the frame element 21 is torn away from the bottom panel 11 along perforated tear lines 27.

Figure 7:
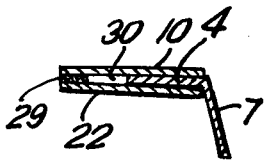
FIG. 7 is a sectional view taken along line 7—7 of FIG. 2.
Figure 2:
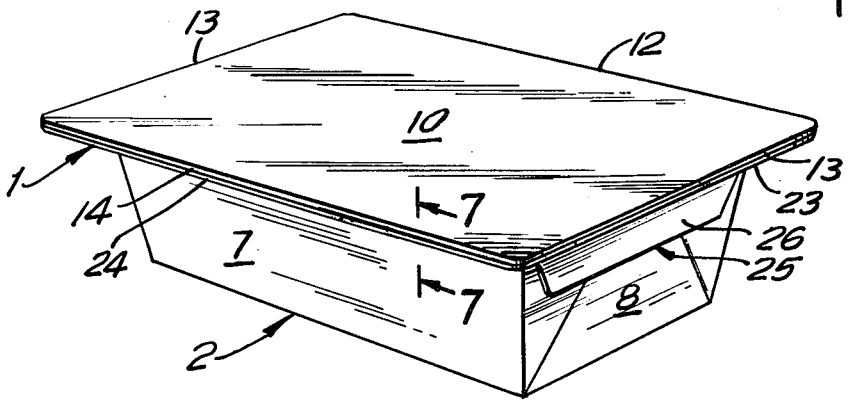
FIG. 2 is a perspective view showing the tray with the lid in its operative sealed position.

To assemble the lid 2 over the tray 1, the tray 1 is first inserted into the opening 20 of the bottom panel 11 so that its flanges 4 and 5 rests on the frame elements 21 and 22, respectively (FIG. 1). The pull tab 26 of the tamper-resistant safety assembly 25 is bent outwardly along fold line 28 so as to be located on the outside of the end wall 8 of the tray 2 (FIG. 2) to permit it to be easily grasped, when desired. The top panel 10 is then folded along line 12 over the bottom panels 11 as well as the tray flanges 4 and 5. The top and bottom panels 10 and 11 are then adhered to each other at their outer edges and along adhesive areas 29 which are outside of tray flanges 4 and 5 so that the tray flanges 4 and 5 are not adhered to and part of the lid 1. In effect, the adhered edges of the top and bottom panels 10 form slide channels 30 (FIG. 7) in which the flanges 4 of the tray may slide.

In this position, the assembled tray may be stored, shipped and placed on a shelf for sale. It will be noted that the lid 1 holds the top of the tray 2 in place to give the tray 2 stability and prevent its walls 7 and 8 from moving outwardly. In this position, the tamper-resistant assembly 25 prevents the contents of the tray from being tampered with. A consumer who purchases this tray knows that since the tamper-resistant assembly 25 is intact, no one has tampered with the contents. On the other hand, if the tamper-resistant assembly is not there or is even partially removed, the consumer knows that the contents may have been tampered with and will not purchase the tray but turn it in to the staff of the retail outlet store. Hence, the possibility of tampering with the contents of trays utilizing the present invention is extremely remote.

Figure 4:
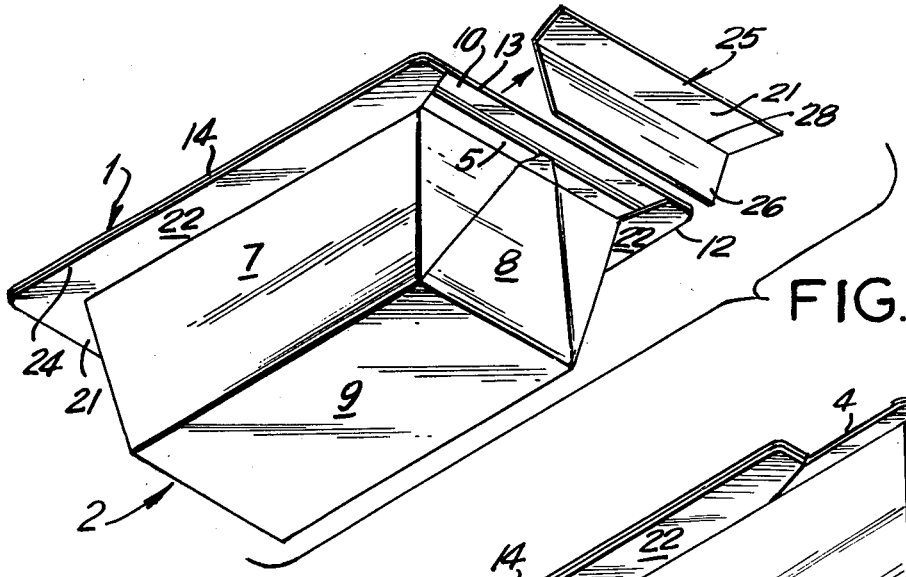
FIG. 4 is an exploded perspective view showing the manner of removing the tamper-resistant safety panel to permit the lid to be removed from the tray.
Figure 5:
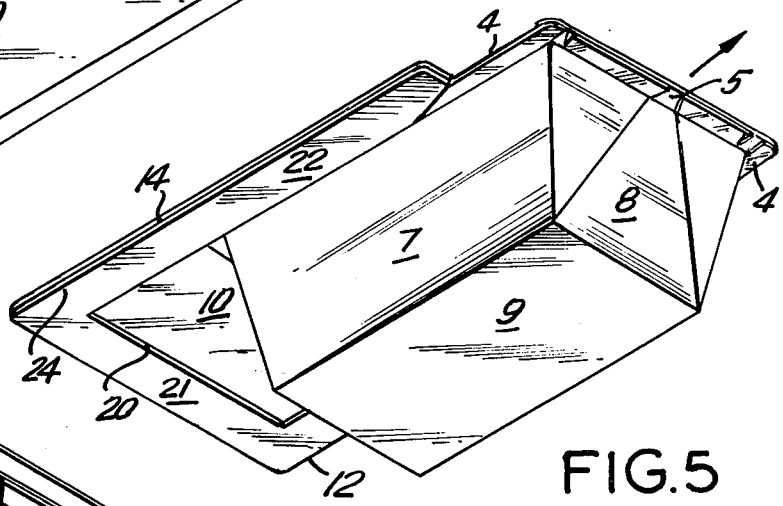
FIG. 5 is a perspective view showing the lid in the process of being removed from the tray.
Figure 6:
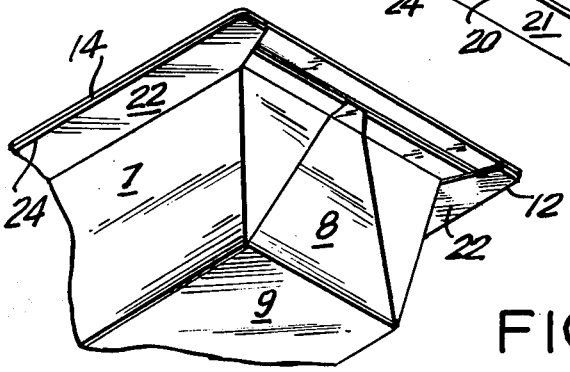
FIG. 6 is a perspective view showing the lid in the process of being replaced on the tray.

When the lid 1 is to be removed from the tray 2, the pull tab 26 of the tamper-resistant safety assembly 25 is pulled away thereby tearing the frame element 21 along the tear lines 27, as shown in FIG. 4, to completely remove it from the lid thereby freeing the lid 1 from the tray 2. The lid 1 can then be removed from the tray 2 by moving the flanges 4 along slide channels 30, as shown in FIG. 5, so that the tray 2 is free to be used. If lid 1 is to be re-applied on to the tray 2, the lid 1 is slid back by moving the side flanges 4 along the channel 30 as shown in FIG. 6.

If it is desired to hermetically seal the tray 2 for sanitary purposes, or if the tray contents are liquid, it is possible to apply a peelable seal, transparent or otherwise, over the tray 2 which will not interfere with the removability and replaceability of the lid. In addition, it is within the purview of the invention to eliminate the use of the tearable tamper-resistant safety tab assembly 25, if desired. For ease in description, the invention has been described with the channels 30 formed along the side flanges and edges of the tray and lid so that the tray slides out of one end of the lid. It will, of course, be understood that the invention is equally applicable to trays and lids in which the channels are formed along the end edges and the tray slides out of the side edge of the lid.

It will thus be seen that the present invention provides an improved lid for a tray which is easily removable and replaceable which uses less paperboard and which may be formed with automatic machinery and which will give the tray greater stability.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A one-piece paperboard blank for forming a lid adapted to close the top of a flanged tray, said blank comprising:

(a) a top panel;

(b) a bottom panel connected to a side edge of said top panel along a fold line, said bottom panel being approximately the same size and shape as said top panel, and said bottom panel having a central opening therein adapted to receive the flanged tray, and being defined by a plurality of peripheral elements interposed between adjacent outer edges of said bottom panel which peripheral elements surround said opening; and (c) a pair of perforated tear lines extending from an edge of said opening across one of said peripheral elements at opposite ends thereof to a corresponding outer edge of said bottom panel.

2. The blank of claim 1 further comprising a tab connected along a fold line to said one of said peripheral elements, said tab extending from said one of said peripheral elements into said opening.

3. The blank of claim 2, wherein said tab has edge portions which are substantially colinear with each of said perforated tear lines.

4. The blank of claim 1 further comprising a strip of adhesive material disposed on one of said top and bottom panels and restricted to outermost edge portions thereof, said adhesive material being adapted to bond said top and bottom panels together when said top and bottom panels are folded into face-to-face contact with each other.

5. A lid for covering a flanged tray, said lid being formed from a one-piece paperboard blank, and said lid comprising:

(a) a top panel;

(b) a bottom panel substantially identical in size and shape to said top panel and foldably connected to said top panel along one edge thereof, said bottom panel being disposed in face-to-face contact with said top panel;

(c) an opening formed medially of said bottom panel, said opening having peripheral edges which combine with outer edges of said bottom panel to define peripheral elements on said bottom panel which surround said opening; and (d) adhesive means disposed on one of said top panel and said bottom panel, said adhesive means being operable to bond outermost edge portions of said top panel to outermost edge portions of said peripheral elements to secure said top and bottom panels in face-to-face contact, inner portions of said peripheral elements being free of bonded securement with said top panel.

6. The lid of claim 5, further comprising a pair of perforated tear lines extending from an edge of said opening across one of said peripheral elements to a corresponding outer edge of said bottom panel to provide means for removing said one of said peripheral elements from the remainder of the lid.

7. The lid of claim 6, further comprising a tab foldably connected to said one of said peripheral elements and extending therefrom into said opening.

8. A package comprising:

(a) a tray having an open top and a peripheral flange surrounding said open top and extending outwardly therefrom; and (b) a lid comprising a top panel overlying said tray flange to close said open top of the tray, said lid further comprising a bottom panel foldably connected to an edge of said top panel and substantially equal thereto in size and shape, said bottom panel having a medial opening through which side wall portions of said tray extend, said opening being defined by peripheral elements surrounding said opening and underlying said tray flange, means for adhesively securing the outermost edge portions of said peripheral elements to outermost portions of said top panel to bond said top and bottom panels to each other without bonding said lid to said tray.

9. The package of claim 8 further comprising a pair of perforated tear lines extending across one of said peripheral elements from an edge of said medial opening to the outer edge of said bottom panel at opposite end portions of said one of said peripheral elements to allow removal of said one of said peripheral elements from the remainder of said lid.

10. The package of claim 9 further comprising a tab foldably connected to an inner edge of said one of said peripheral elements, said tab being deflected into engagement with a side wall of the tray and providing gripping means whereby said one of said peripheral elements can be grasped and torn from the remainder of said lid via said pair of perforated tear lines.

11. The package of claim 9 wherein opposed portions of said peripheral elements and said top panel inwardly adjacent to said adhesively secured portions of said peripheral elements and said top panel combine to form opposite slide channels slidably containing said tray flange, said slide channels having corresponding ends terminating at said one of said peripheral elements whereby said lid can be slid off of said tray flange after removal of said one of said peripheral elements from the remainder of said lid.

* * * * *